US007083685B1

(12) United States Patent
Katori et al.

(10) Patent No.: US 7,083,685 B1
(45) Date of Patent: Aug. 1, 2006

(54) GRAY CAST IRON MEMBER

(75) Inventors: Noriaki Katori, Hino (JP); Shouichi Ishii, Sodegaura (JP)

(73) Assignees: Hino Motors, Ltd., Tokyo (JP); Kasuya Seiko Kabushiki Kaisha, Sodergaura (JP)

( * ) Notice: Subject to any disclaimer, the term of this patent is extended or adjusted under 35 U.S.C. 154(b) by 0 days.

(21) Appl. No.: 11/181,988

(22) Filed: Jul. 15, 2005

(51) Int. Cl.
*C22C 37/00* (2006.01)

(52) U.S. Cl. ..... 148/321; 420/13; 420/14; 420/15

(58) Field of Classification Search ..... 148/321; 420/13–15
See application file for complete search history.

(56) References Cited

U.S. PATENT DOCUMENTS

| | | | |
|---|---|---|---|
| 4,807,728 | A | 2/1989 | Suenaga et al. |
| 4,859,414 | A | 8/1989 | Arai |
| 4,891,076 | A | 1/1990 | Kovacs |
| 4,948,437 | A | 8/1990 | Metzler |
| 5,032,194 | A | 7/1991 | Metzler |
| 5,858,127 | A | 1/1999 | Ott et al. |
| 6,053,990 | A | 4/2000 | Persson et al. |
| 6,613,274 | B1 | 9/2003 | Dawson |

FOREIGN PATENT DOCUMENTS

| | | | |
|---|---|---|---|
| JP | 2002-105581 | | 4/2002 |
| JP | 2003-247014 | | 9/2003 |
| JP | 2004232041 | * | 8/2004 |
| SU | 1680795 | * | 9/1991 |

* cited by examiner

*Primary Examiner*—Sikyin Ip
(74) *Attorney, Agent, or Firm*—Oblon, Spivak, McClelland, Maier & Neustadt, P.C.

(57) ABSTRACT

A gray cast iron member includes 2.2–2.8 weight % C, 2.3–3.5 weight % Si, 0.2–0.8 weight % Mn, up to 0.1 weight % P, up to 0.15 weight % S, 0.6–1.4 weight % Cu, up to 0.5 weight % Mo, up to 0.3 weight % Cr, and the balance substantially Fe, Si/C being 0.95 or more, (Si/C)/Cu being up to 1.5. Preferably, it further includes at least one of Ni, Sn, V, Sb and N each in an amount of up to 0.3 weight %.

6 Claims, 4 Drawing Sheets

100×

100×

GRAY CAST IRON MEMBER

BACKGROUND OF THE INVENTION

1. Field of the Invention

The present invention relates to a gray cast iron member.

2. Description of the Related Art

Gray cast iron, which has been disclosed for example in JP 2002-105581 A and JP 2003-247014 A, is excellent in productivity and wear resistance but is low in tensile strength so that its application to structural parts is much limitative. In order to overcome this and to facilitate applications of gray cast iron to structural parts such as locker arms for actuation of suction and discharge vales in a vehicle engine, it has been practiced to highly strengthen the gray cast iron. Such highly strengthened gray cast iron may be fabricated, for example, through (1) low carbon or inoculation technique or (2) addition of alloys.

Of such highly strengthened gray cast iron, the gray cast iron of type (1) is disadvantageous in cost and productivity since steel scrap as much as 40–100% is used when raw material is to be molten, and casting is conducted through recarburization. In the gray cast iron of type (2), char tends to be separated out at thin portions and such thin portions with char separated out have characteristics substantially different from those required originally, which disadvantageously limits tensile strength of ordinary gray cast iron to be of the order of at most 350 MPa.

The present invention was made in view of the above and has its object to provide a gray cast iron member which has no substantial increase in hardness, is excellent in wear resistance, has tensile strength of 400 MPa or more and has high productivity.

BRIEF SUMMARY OF THE INVENTION

A gray cast iron member according to the invention or inventive gray cast iron member consists essentially of 2.2–2.8 weight % C, 2.3–3.5 weight % Si, 0.2–0.8 weight % Mn, up to 0.1 weight % P, up to 0.15 weight % S, 0.6–1.4 weight % Cu, up to 0.5% Mo, up to 0.3 weight % Cr, and the balance substantially Fe, Si/C being 0.95 or more, (Si/C)/Cu being up to 1.5.

Preferably, the inventive gray cast iron member further includes at least one of Ni, Sn, V, Sb and N each in an amount of up to 0.3 weight %.

DETAILED DESCRIPTION OF THE PREFERRED EMBODIMENT

An embodiment of the invention will be described in conjunction with the drawings.

The inventors made various researches in the above-mentioned viewpoint to develop a gray cast iron member (inventive member) which has strength as high as 400 MPa or more, is excellent in wear resistance and has high productivity. Thus, as shown in left in Table 1 below, the inventive member consists essentially of 2.2–2.8 weight % C, 2.3–3.5 weight % Si, 0.2–0.8 weight % Mn, up to 0.1 weight % P, up to 0.15 weight % S, 0.6–1.4 weight % Cu, up to 0.5% Mo, up to 0.3 weight % Cr, and the balance substantially Fe. In addition to the above, the inventive member may further include at least one of Ni, Sn, V, Sb and N each in an amount of up to 0.3 weight %.

TABLE 1

| | inventive member | conventional member (JIS FC250) |
|---|---|---|
| C | 2.2–2.8 | 3.10–3.45 |
| Si | 2.3–3.5 | 1.80–2.30 |
| Mn | 0.2–0.8 | 0.5–0.7 |
| P | up to 0.1 | up to 0.1 |
| S | up to 0.15 | up to 0.15 |
| Cu | 0.6–1.4 | — |
| Mo | up to 0.5 | — |
| Cr | up to 0.3 | — |

Figure 1:
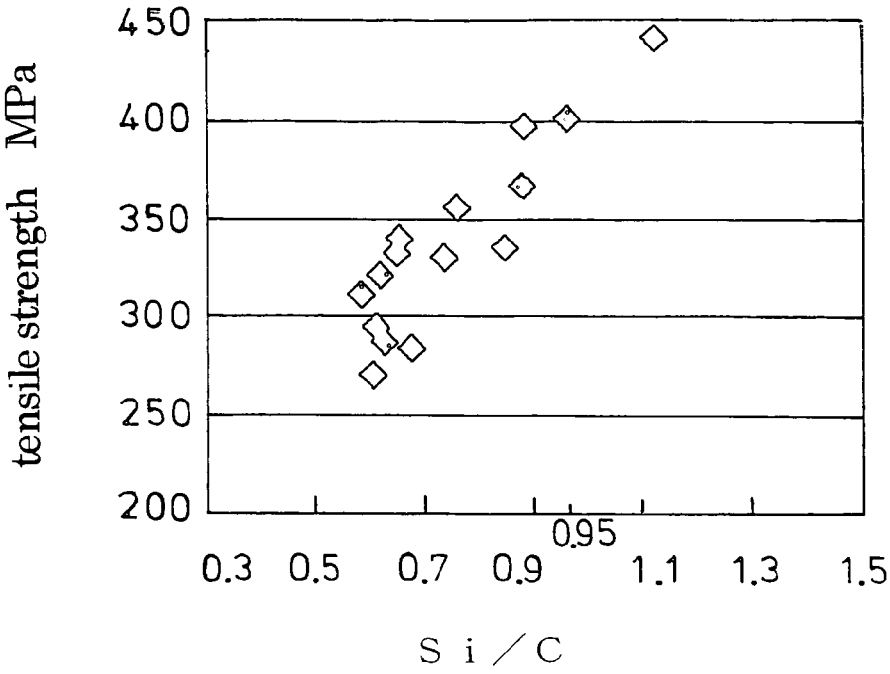
FIG. 1 is a graph showing a relationship between Si/C and tensile strength MPa in the inventive member.

Si/C in the inventive member is 0.95 or more since, as is clear from the graph in FIG. 1, Si/C being 0.95 or more is required in order to have tensile strength of 400 MPa or more.

Figure 2:
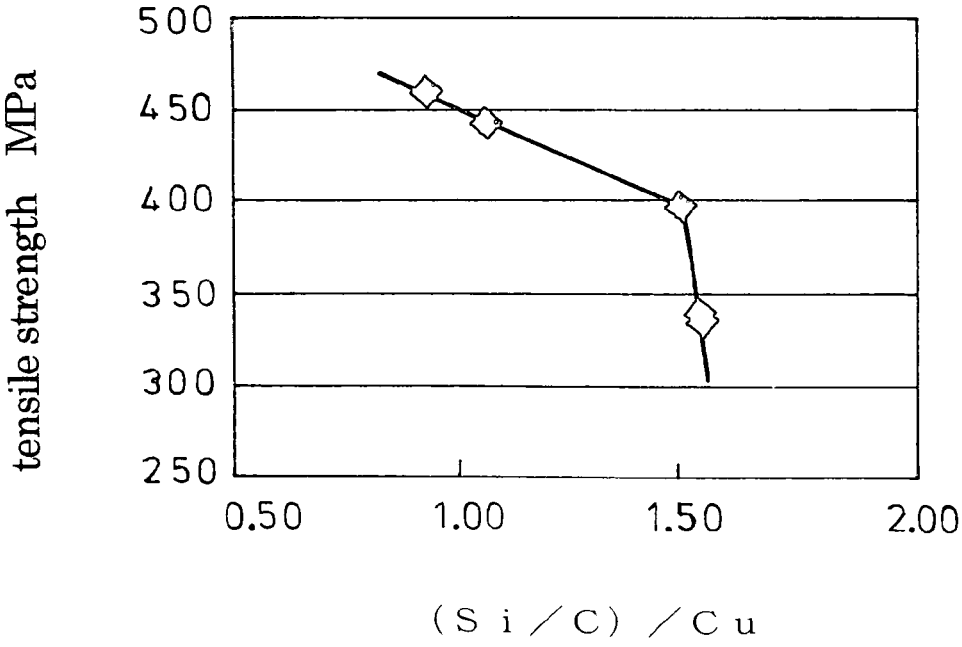
FIG. 2 is a graph showing a relationship between (Si/C)/Cu and tensile strength MPa in the inventive member.

(Si/C)/Cu in the inventive member is up to 1.5 since, as is clear from the graph in FIG. 2, (Si/C)/Cu being up to 1.5 is required in order to have tensile strength of 400 MPa or more. Inoculating treatment may or may not be effected for adjustment of the metallurgical structure of the inventive member. Shown in right in Table 1 above is a chemical component of the conventional member (JIS FC250) for reference.

Figure 3:
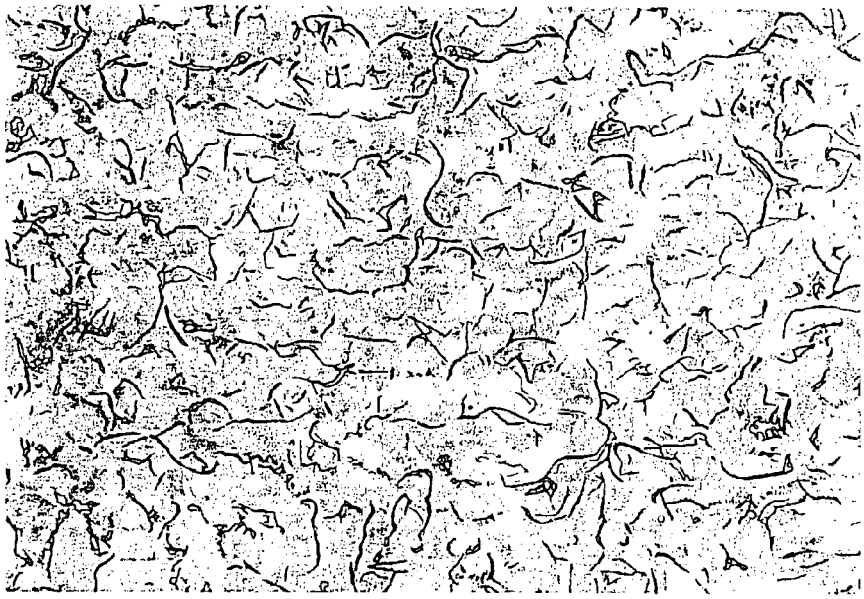
FIG. 3 is a photomicrograph of a metallurgical structure of the inventive member (nital etching)
Figure 4:
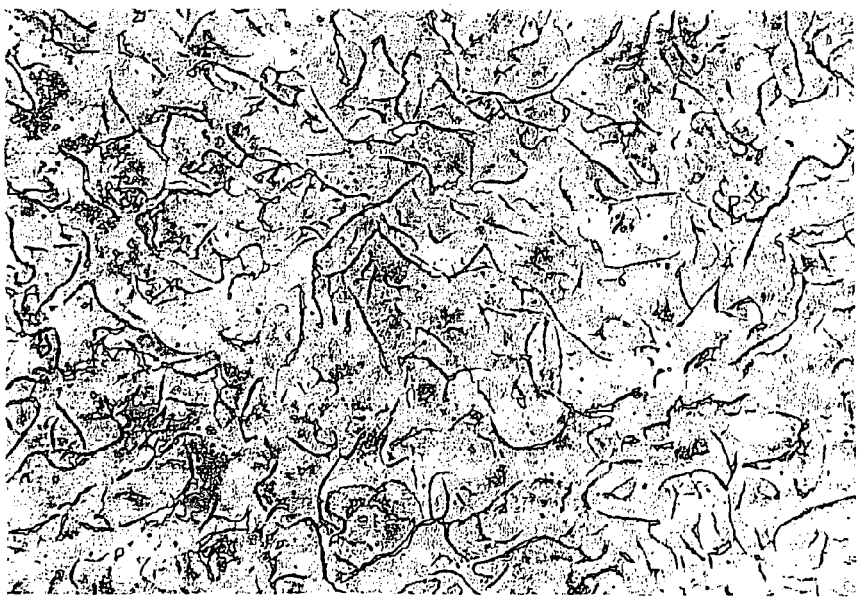
FIG. 4 is a photomicrograph of a metallurgical structure of a conventional member (JIS FC250; nital etching)

In comparison with longer graphite flakes in the metallurgical structure of the conventional member (JIS FC250) as shown in FIG. 4, the inventive member has dense and minute graphite flakes dispersed in the base structure as shown in FIG. 3. The base structure comprises minute perlite without or with a some amount of ferrite.

Figure 5:
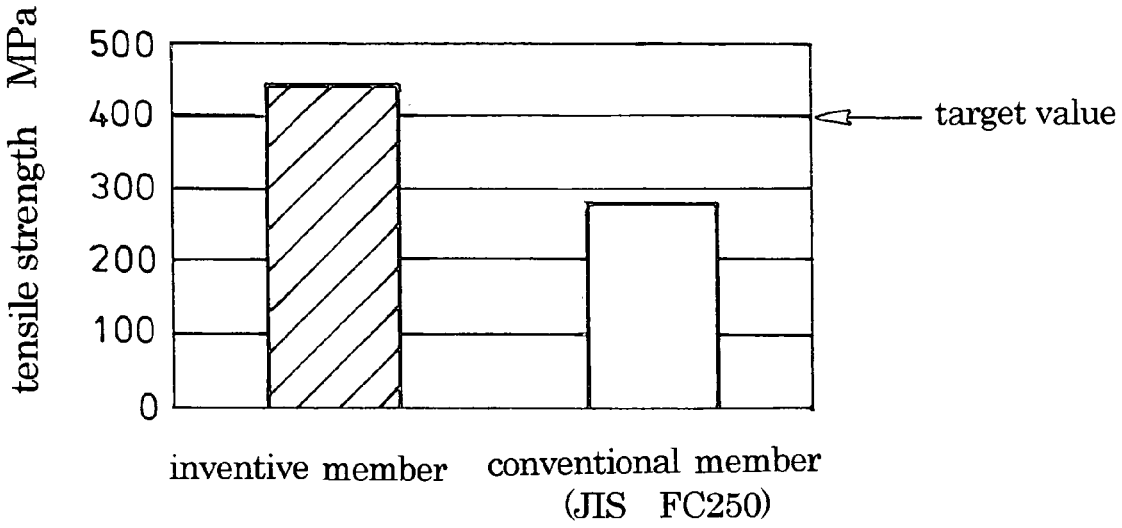
FIG. 5 is a graph showing tensile strength MPa of the inventive member and of the conventional member (JIS FC250)
Figure 6:
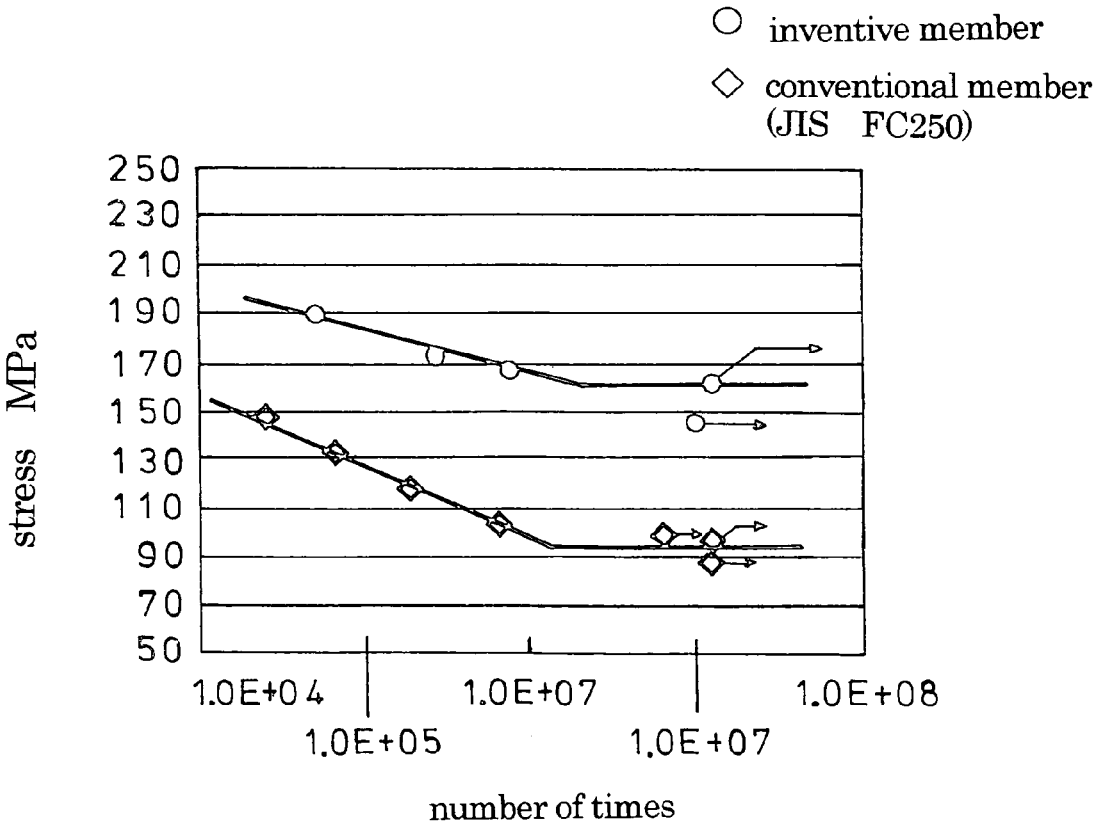
FIG. 6 shows N-S curves representing fatigue limits of the inventive member and of the conventional member (JIS FC250)

The inventive member has the tensile strength of about 440 MPa as shown in FIG. 5, which is improved in tensile strength by about 60% in comparison with the conventional member or Cr—Mo alloyed cast iron (JIS FC250) which has the tensile strength of about 280 MPa. The inventive member has the fatigue limit of 150 MPa or more as shown by an upper one of the N-S curves in FIG. 6, which is improved in fatigue limit by about 60% in comparison with the conventional member or Cr—Mo alloyed cast iron (JIS FC250) which has the fatigue limit of about 95 MPa. The inventive member has hardness HV of up to 280, which is a little higher than that of the conventional member.

Figure 7:
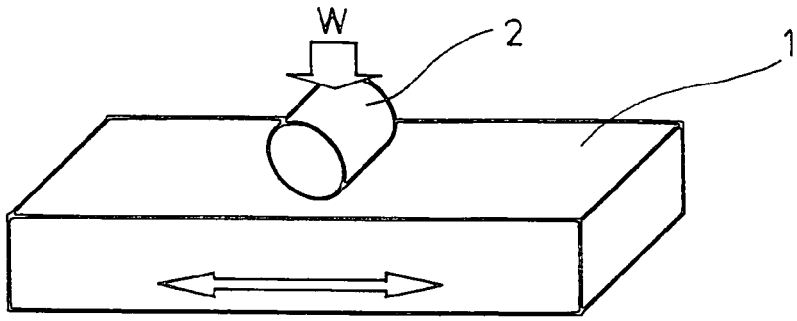
FIG. 7 is a perspective view showing a state of wear resistance test on the inventive member and on the conventional member (JIS FC250)

Wear resistance tests were conducted on the conventional member or Cr—Mo alloyed cast iron (JIS FC250) and on the inventive member, using a reciprocating wear testing machine as shown in FIG. 7 in which reference numeral 1 denotes a test piece of the conventional or inventive member, the test piece 1 being reciprocated by a stroke of 8 mm. Reference numeral 2 designates a cylindrical load-adding member made of steel material (JIS SUJ2) in the reciprocating test machine, the test piece 1 being adapted to receive a predetermined load W through the load-adding member 2.

Thus, the wear resistance tests were carried out with a surface pressure provided by the load W to the test piece 1 being 575 MPa, with two standards of sliding (mean) velocity of the test piece 1 being 0.3 m/s and 0.07 m/s, with a sliding distance being 4000 m and with an ambient temperature being room temperature, an engine oil being supplied as lubricant only at the start of the tests.

Figure 8:
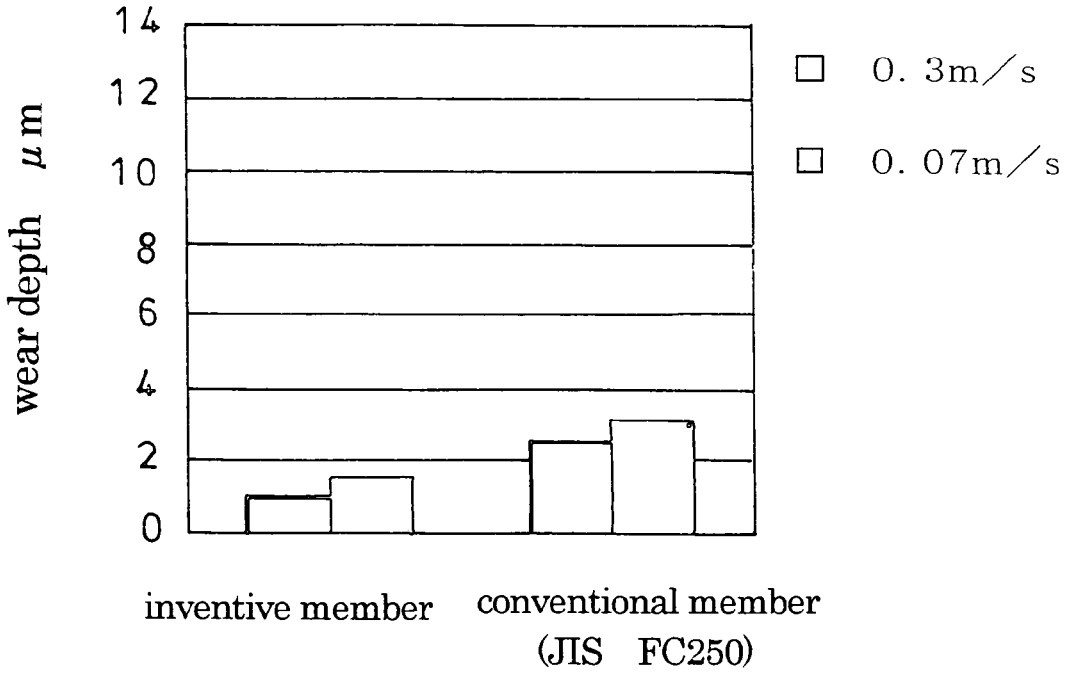
FIG. 8 is a graph showing wear depth of the inventive member and of the conventional member (JIS FC250).

Results of the wear resistance test are shown in FIG. 8 where the inventive member has the wear depth of about 1.0 μm when the sliding velocity is 0.3 m/s and has the wear depth of about 1.5 μm when the sliding velocity is 0.07 m/s. The conventional member or Cr—Mo alloyed cast iron (JIS FC250) has the wear depth of about 2.5 μm when the sliding velocity is 0.3 m/s and has the wear depth of about 3.0 μm when the sliding velocity is 0.07 m/s. In other words, in the case where the sliding velocity is 0.3 m/s, the inventive member has the wear depth decreased to about ⅖ of that of the conventional member; in the case where the sliding velocity is 0.07 m/s, the inventive member has the wear depth decreased to about ½ of that of the conventional member.

Thus, according to the invention, a gray cast iron member can be obtained which has little char separated out, has no substantially increased hardness, is excellent in wear resistance, has tensile strength of 400 MPa or more and has high productivity.

It is to be understood that the invention is not limited to the above embodiment and that various changes and modifications may be made without departing from the scope and spirit of the invention.

What is claimed is:

1. A gray cast iron member consisting essentially of 2.2–2.8 weight % C, 2.3–3.5 weight % Si, 0.2–0.8 weight % Mn, up to 0.1 weight % P, up to 0.15 weight % S, 0.6–1.4 weight % Cu, up to 0.5 weight % Mo, up to 0.3 weight % Cr, and the balance substantially Fe, Si/C being 0.95 or more, (Si/C)/Cu being up to 1.5.

2. The gray cast iron member according to claim 1, further comprising at least one of Ni, Sn, V, Sb and N each in an amount of up to 0.3 weight %.

3. The gray cast iron member according to claim 1, wherein the gray cast iron member has a tensile strength of 400 MPa or more.

4. The gray cast iron member according to claim 1, wherein the gray cast iron member has a fatigue limit of 150 MPa or more.

5. The gray cast iron member according to claim 1, wherein the gray cast iron member has a hardness HV of up to 280.

6. A method of making a gray cast iron member, the method comprising casting a melt consisting essentially of 2.2–2.8 weight % C, 2.3–3.5 weight % Si, 0.2–0.8 weight % Mn, up to 0.1 weight % P, up to 0.15 weight % S, 0.6–1.4 weight % Cu, up to 0.5 weight % Mo, up to 0.3 weight % Cr, and the balance substantially Fe; and producing the member of claim 1.

* * * * *